US006712001B2

(12) United States Patent
Plewa

(10) Patent No.: US 6,712,001 B2
(45) Date of Patent: Mar. 30, 2004

(54) ARRANGEMENT FOR ADJUSTING THE INTERVAL BETWEEN THE ROTATIONAL AXES OF CYLINDERS

(75) Inventor: Stephan Rolf Plewa, Schloss Holte-Stukenbrock (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/257,984

(22) PCT Filed: Feb. 5, 2001

(86) PCT No.: PCT/DE01/00436

§ 371 (c)(1),
(2), (4) Date: Oct. 30, 2002

(87) PCT Pub. No.: WO01/83214

PCT Pub. Date: Nov. 8, 2001

(65) Prior Publication Data

US 2003/0075060 A1 Apr. 24, 2003

(30) Foreign Application Priority Data

May 3, 2000 (DE) ..... 100 21 540

(51) Int. Cl.[7] ..... B41F 13/28
(52) U.S. Cl. ..... 101/218; 101/247
(58) Field of Search ..... 101/216, 218, 101/247, 182, 184, 185, 139, 140, 144, 145, 351.1, 351.2, 351.3, 351.4, 352.01, 352.02, 352.03, 352.04, 352.05

(56) References Cited

U.S. PATENT DOCUMENTS

| | | | | | |
|---|---|---|---|---|---|
| 4,815,377 | A | * | 3/1989 | Skiera | 101/218 |
| 5,081,927 | A | * | 1/1992 | Jahn | 101/218 |
| 5,355,796 | A | | 10/1994 | Kobler et al. | |
| 5,445,076 | A | * | 8/1995 | Sugiyama et al. | 101/218 |
| 5,676,057 | A | | 10/1997 | Hummel et al. | |
| 5,697,296 | A | | 12/1997 | Thunker et al. | |

FOREIGN PATENT DOCUMENTS

| | | |
|---|---|---|
| DE | 2 113 608 | 9/1972 |
| DE | 42 11 379 A1 | 10/1993 |
| DE | 195 16 131 A1 | 11/1998 |
| EP | 0 591 792 A1 | 4/1994 |
| EP | 0 739 720 A2 | 10/1996 |
| EP | 0 741 018 A2 | 11/1996 |
| GB | 2 206 081 A | 6/1988 |

* cited by examiner

*Primary Examiner*—Stephen R. Funk
*Assistant Examiner*—Leo T. Hinze
(74) *Attorney, Agent, or Firm*—Jones Tullar & Cooper PC

(57) ABSTRACT

The interval or spacing between rotational axes of adjacent cylinders in a rotary printing press, between a print-on position and a print-off position is accomplished using eccentric bushings for the cylinder journals of at least one of the cylinders. A printing gap between the two cylinders can also be varied using separate eccentric bushings. The effective eccentricity of the bushings extends parallel to a line connecting the axes of rotation of the cylinders.

7 Claims, 2 Drawing Sheets

ARRANGEMENT FOR ADJUSTING THE INTERVAL BETWEEN THE ROTATIONAL AXES OF CYLINDERS

FIELD OF THE INVENTION

The present invention is directed to an arrangement for setting the spacing between the axes of rotation of cylinders. The cylinders are cooperating cylinders of a rotary printing press and are each supported by eccentric bushings.

BACKGROUND OF THE INVENTION

Printing units are known from DE 42 11 379 A1. The ink application rollers of these printing units are each seated, on both sides, in two adjustable eccentric bushings .

EP 0 591 792 A1 discloses a rubber blanket cylinder of a printing press whose journal is seated in a first eccentric bushings for use in putting the cylinder into or out of the printing position. A second bushing is used for setting the paper thickness.

SUMMARY OF THE INVENTION

The object of the present invention is directed to providing an arrangement for the selective setting of the spacing between two cylinders of a printing press.

In accordance with the present invention, the object is attained by the provision of first and second eccentric bushings that support a blanket cylinder for movement with respect to a counter-pressure cylinder. The first eccentric bushing, or bushings are used to move the blanket cylinder between printing and non-printing positions. The second eccentric bushing, or bushings are used to set a variable printing gap between the two cylinders.

The advantages which can be achieved by the present invention lie, in particular, in that by the use of a shaft journal seating in accordance with the present invention, it is possible, on the one hand, to move a cylinder, for example a rubber blanket cylinder, away from one or two adjoining cylinders of a printing unit. On the other hand, a separate, differentiated setting of a print gap toward an adjoining cylinder can be performed by simple technical elements without changing the print gap toward a second adjoining cylinder.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENT

Figure 1:
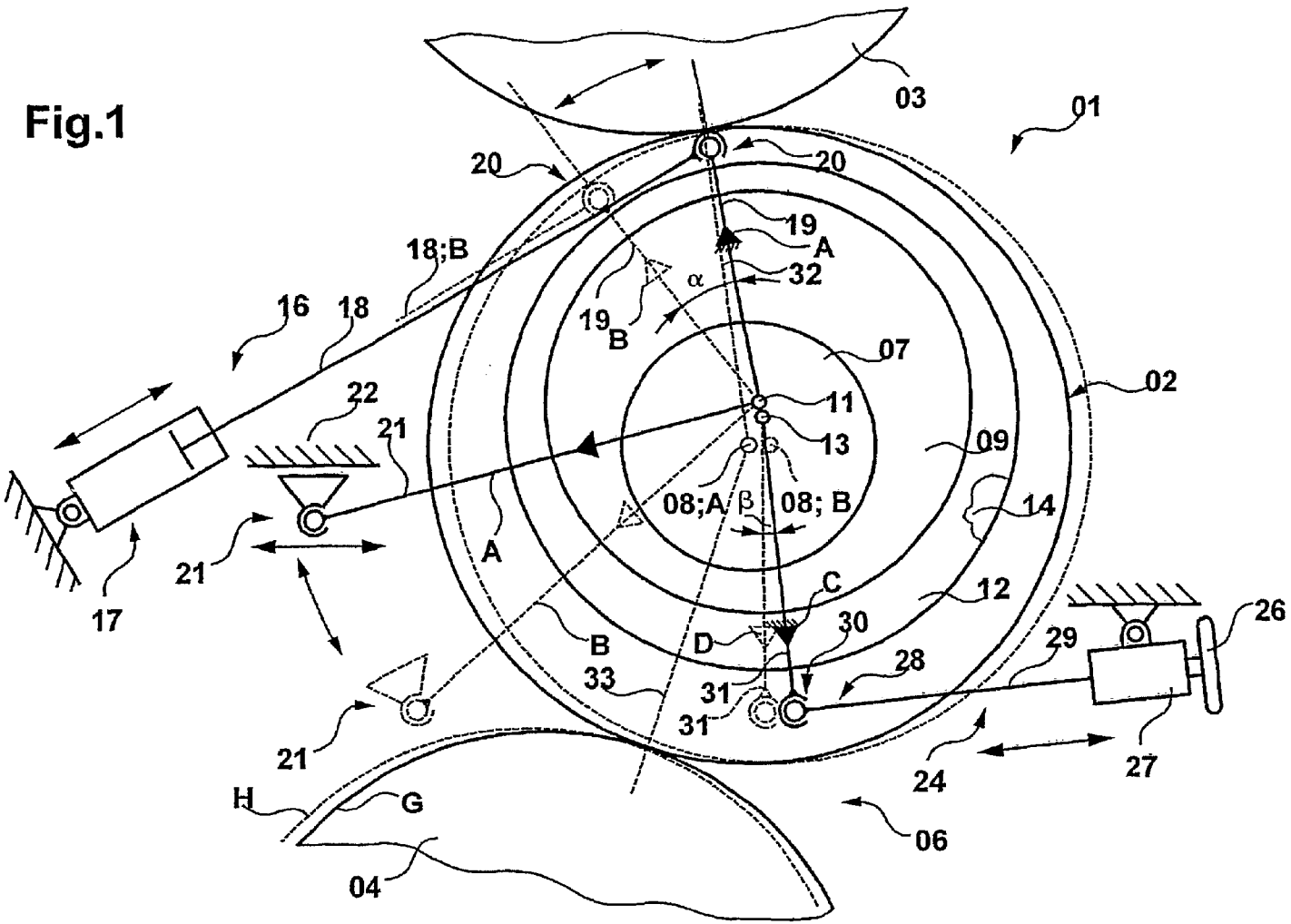
FIG. 1, a schematic side elevation view of a printing position of a cylinder, of an arrangement for placing a cylinder into a print-on and print-off position in accordance with the present invention, and in FIG. 2, an enlarged depiction of the journal areas of a cylinder in accordance with FIG. 1 and with a paper thickness setting device.

A transfer cylinder 01, for example a rubber blanket cylinder 01 of a printing unit of a rotary printing press, is depicted in the side elevation view of FIG. 1. A periphery 02 of cylinder 01 rests against the periphery of a forme cylinder 03. The rubber blanket cylinder 01 can be placed against a counter-pressure cylinder 04, for example a second rubber blanket cylinder 04, and is represented in this position by solid lines, as seen in FIG. 1. A print gap 06 for the passage of, for example a paper web, for printing the paper web, which paper web is not specifically represented in FIG. 1, is formed between the two cylinders 01, 04.

A first cylinder journal 07, which may be, for example a shaft journal of the rubber blanket cylinder 01, and which has a cylinder axis or an axis of rotation 08, is seated in a first, inner eccentric cylinder bushing 09 which has a cylinder axis or an axis of rotation 11. It is possible to obtain a first eccentricity "e" of, for example 12 mm, between the two axes of rotation 08, 11.

The first eccentric cylinder bushing 09 is, in turn, rotatably seated in a second, outer eccentric cylinder bushing 12, which has an axis of rotation 13. The second, outer cylinder bushing 12 is seated, so it can be rotated, in a bore 14 of a lateral frame of the printing press, which lateral frame is not specifically represented in the drawings. By use of this second, outer eccentric cylinder bushing 12, it is possible to obtain a second eccentricity "f" of 3 mm, for example, between the axis of rotation 11 of the first, inner cylinder bushing 09 and the axis of rotation 13 of the second, outer cylinder bushing 12. It is possible to arrange rolling bearings, which are not specifically represented, in particular needle bearings, or cylinder roller bearings, between each of the cylinder journal 07, the first cylinder bushing 09, the second cylinder bushing 12, as well as the lateral frame bore 14. Any other type of rolling bearing or sliding bearing is also useable.

The ratio of the two eccentricities "e" to "f" lies in the range of 2 to 6, preferably in the range 3 to 5, and in particular in the range 3.5 to 4.5.

The first, inner cylinder bushing 09 can be pivoted, for example by the use of a first linear drive mechanism 16, over a setting angle a of 20 to 30°, for example 25°, out of a first, or print-on position A into a second, or print-off position B, which second position is shown by dashed lines in FIG. 1. In this embodiment, the first linear drive mechanism 16 can consist of a work cylinder 17, for example of a double-action, compressed air cylinder, that is pivotably seated in a lateral frame of the printing press. The free end of a piston rod 18 of cylinder 17 is connected, through a joint 20, with a first bracket 19 which is fastened to the side of the first, inner eccentric cylinder bushing 09. A second bracket 21, whose free end is used as a support, is arranged at approximately 90 degrees with respect to the first bracket 19, on the side of the first, inner eccentric cylinder bushing 09. In the first, print-on position A, this support 21 works in cooperation with a stop 22 that is fixed on the lateral frame. In this preferred embodiment, the stop 22 can be embodied as a sliding bearing 22, for example.

The second, outer eccentric cylinder bushing 12 can be pivoted, for example by the use of a second linear drive mechanism 24, over a setting angle βof approximately two to five degrees, for example of three degrees, out of a first or wide setting C of the printing gap 06 into a second or narrow setting D of the printing gap 06.

The second linear drive mechanism 24 can, for example, consist of a threaded spindle drive, or of a worm drive 27, and is hinged on the lateral press frame and is operable by use of a hand wheel 26. A free end 28 of the threaded spindle 29, or worm drive 27 that forms the second linear drive mechanism 24, is connected, via a joint 30, to a third bracket 31, which is fastened on the side of the second, outer eccentric cylinder bushing 12.

The arrangement for setting the spacing between the rotational axes of cylinders, in accordance with the present invention, operates as follows. The rubber blanket cylinder

01 can be brought from the first print-on position A into the second print-off position B by actuating the working cylinder 17, and thus rotating the first, inner eccentric cylinder bushing 09, as seen in FIG. 1. In the process, the existing printing gap 06 between the first and second rubber blanket cylinders 01, 04 is increased to a print-off position, and simultaneously a printing gap 06 between the first rubber blanket cylinder 01 and the forme cylinder 03 is increased also to a print-off position.

The second rubber blanket cylinder, or counter-pressure cylinder 04 can also be displaced from a print-on position G into a print-off position H by supporting it in eccentric bushes, which are not specifically represented.

Because of the activation of the second linear drive 24, for displacing the second, outer eccentric cylinder bushing 12, it is possible, in the print-on position A of the rubber blanket cylinder 01, to achieve a change of the width of the printing gap 06, for example from −50 $\mu$m to +100 $\mu$m from the set zero position. This takes place between the narrow setting D and the wide setting C of the printing gap 06 as shown in FIG. 2, for example between ±50 $\mu$m.

The effective direction of the eccentricity "f" of the second, outer cylinder bushing 12 extends approximately parallel with an imaginary connecting line 32 extending between the axis of rotation 08 of the first rubber blanket cylinder 01 and an axis of rotation, which is not specifically represented, of the adjoining forme cylinder 03.

The axes of rotation 08 of the first rubber blanket cylinder 01, and of the second rubber blanket cylinder 04 are connected by the imagined connecting line 33, as may also be seen in FIG. 1.

Figure 2:
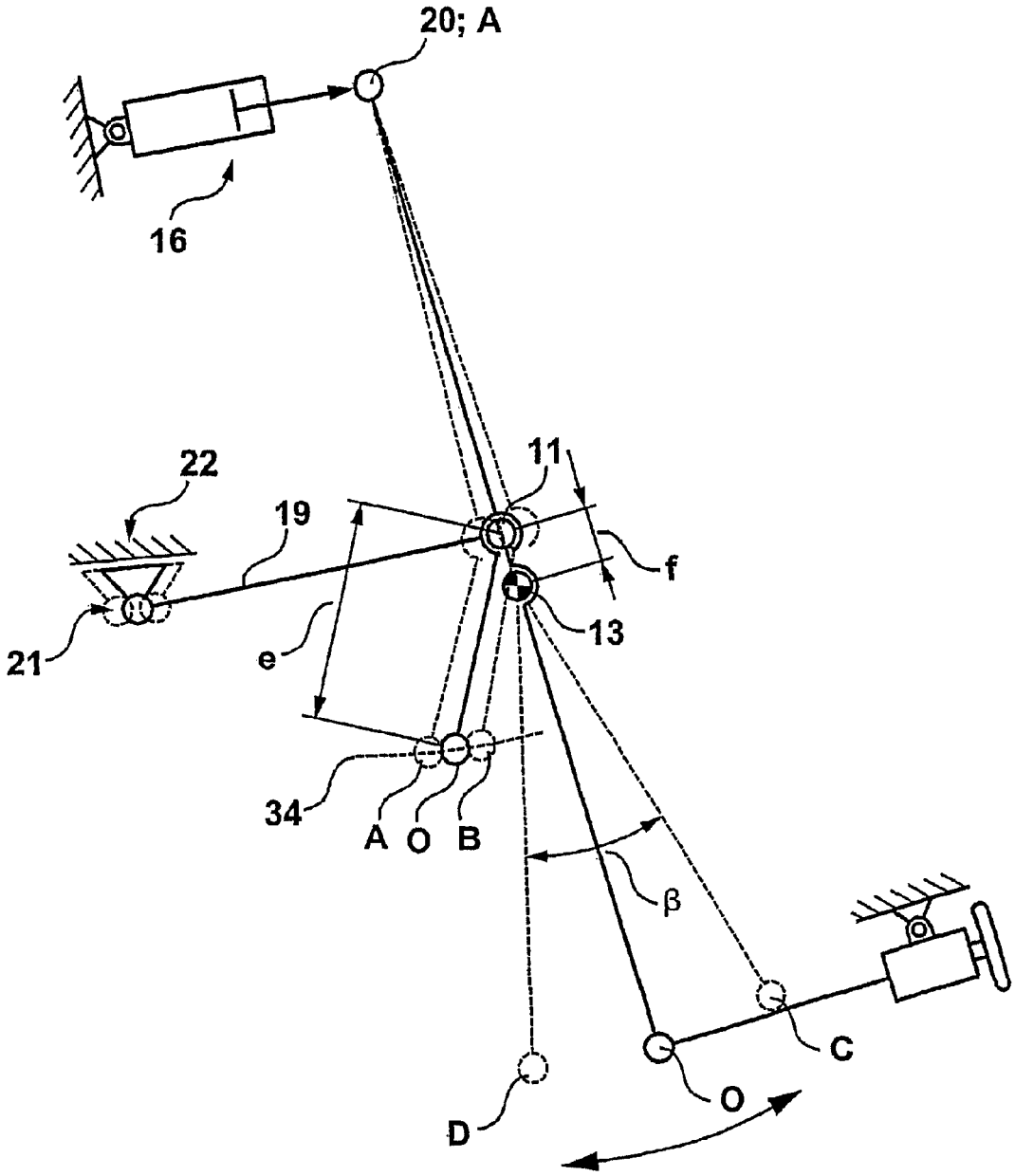

If, because of, for example, a reduced paper thickness, the printing gap 06 between the cylinders 01, 04 existing in the print-on position A is to be changed from a normal position O, for example for a paper weight or density of 80 g/m$^2$, to a narrow setting D, the linear drive 24 is moved to the left, as shown in FIG. 2.

If a wide setting C of the printing gap 06 is to be achieved, the linear drive 24 is moved from the normal position O in the opposite direction, again as seen in FIG. 2.

In the course of the displacement of the second, outer eccentric cylinder bushing 12 about its axis of rotation 13 by operation of the second linear drive 24, the first, inner eccentric cylinder bushing 09, as well as the support 21 are displaced on the sliding bearing 22. The axis of rotation 11 of the first, inner eccentric cylinder bushing 09 changes its position O–C, or O–D in a direction that is parallel with a setting curve 34 of the paper thickness described by the axis of rotation 08 of the first rubber blanket cylinder 01 when the paper thickness changes.

Each point on the setting curve 34 has approximately the same distance to the axis of rotation of the forme cylinder 03 and therefore does not change this distance. Accordingly, the periphery 02 of the first rubber blanket cylinder 01 remains in the vicinity of the periphery of the forme cylinder 03.

Approximately parallel is to be understood to be an opening angle between two straight lines of ±10°, in particular ±5°.

While a preferred embodiment of an arrangement for setting the spacing between the rotational axes of cylinders in accordance with the present invention has been set forth fully and completely hereinabove, it will be apparent to one of skill in the art that various changes in, for example, the specific type of printing press used, the overall sizes of the cylinders, and the like could be made without departing from the true spirit and scope of the present invention which is accordingly to be limited only by the following claims.

What is claimed is:

1. An arrangement for setting a distance between axes of rotation in a rotary printing press comprising:

a first cylinder having a first cylinder journal and a first cylinder axis of rotation;

a second cylinder;

a first eccentric bushing supporting said first cylinder journal bushing for movement between a first print-on position and a second print-off position with respect to said second cylinder, said first eccentric bushing having a first axis of rotation and a first eccentricity;

a second eccentric bushing supporting said first cylinder journal for changing a variable printing gap between said first cylinder and said second cylinder, said second eccentric bushing having a second axis of rotation and a second eccentricity, a ratio of said first eccentricity to said second eccentricity being less than six and greater than 2; and a third cylinder adjacent said first cylinder wherein a first straight line extending between said first eccentric bushing axis of rotation and said second eccentric bushing axis of rotation is parallel to a line connecting an axis of rotation of said first cylinder and an axis of rotation of said third cylinder.

2. The arrangement of claim 1 wherein said second cylinder is a rubber blanket cylinder.

3. The arrangement of claim 1 wherein said first cylinder is a rubber blanket cylinder, said second cylinder is a counter-pressure cylinder and said third cylinder is a forme cylinder.

4. An arrangement for setting a distance between axes of rotation in a rotary printing press comprising:

a first cylinder having a first cylinder journal and a first cylinder axis of rotation;

a second cylinder;

a first eccentric bushing supporting said first cylinder journal for movement between a print-on position and a print-off position with respect to said second cylinder, said first cylinder axis of rotation defining a setting curve having end points during said movement between said print-on position and said print-off position;

a second eccentric bushing supporting said first cylinder journal for setting a variable printing gap between said first cylinder and said second cylinder;

a support on said first eccentric bushing; and a sliding bearing fixed on a lateral frame of the rotary printing press, said sliding bearing having an effective area, said support being in operative contact with said sliding bearing when said first cylinder is in said print-on position, said effective area of said sliding bearing extending approximately parallel with a straight line connecting said end points of said setting curve.

5. The arrangement of claim 4 wherein said second cylinder is a rubber blanket cylinder.

6. The arrangement of claim 4 further comprising: a third cylinder adjacent said first cylinder, said third cylinder having an axis of rotation, wherein a first straight line extending between said first eccentric bushing axis of rotation and said second eccentric bushing axis of rotation is parallel to a line connecting an axis of rotation of said first cylinder and an axis of rotation of said third cylinder.

7. The arrangement of claim 4 wherein said first cylinder is a rubber blanket cylinder and said second cylinder is a counter-pressure cylinder.

* * * * *